United States Patent [19]

Smilgys

[11] 4,426,574

[45] Jan. 17, 1984

[54] FUEL PUMP COUNTER READOUT

[75] Inventor: Bruno S. Smilgys, Hartford, Conn.

[73] Assignee: Veeder Industries Inc., Hartford, Conn.

[21] Appl. No.: 329,724

[22] Filed: Dec. 11, 1981

[51] Int. Cl.[3] ..... B67D 5/22

[52] U.S. Cl. ..... 235/1 C; 235/94 R

[58] Field of Search ..... 235/1 C, 61 J, 61 M, 235/94 R, 94 A

[56] References Cited

U.S. PATENT DOCUMENTS

| | | | |
|---|---|---|---|
| 2,932,448 | 4/1960 | Bliss | 235/144 R |
| 3,727,833 | 4/1973 | Muller | 235/1 C X |
| 3,766,731 | 10/1973 | Shigetz | 235/1 C X |
| 4,136,573 | 1/1979 | Smilgys et al. | 74/348 |

*Primary Examiner*—Benjamin R. Fuller

*Attorney, Agent, or Firm*—Prutzman, Kalb, Chilton & Alix

[57] ABSTRACT

A fuel dispenser cost counter having a plurality of coaxial cost counter wheels with a 100 count first order counter wheel with ten, 36° spaced, two-place identifying numerals of 00, 10, 20 . . . 90 having an angular height of 30°, ten-count graduations centered on the identifying numerals and intermediate five-count graduations between the identifying numerals and with both the ten-count and five-count graduations extending at least substantially the full width of the identifying numerals and such that the counter can be read without substantial readout ambiguity during a count transfer from the first order counter wheel to the next higher order counter wheel.

8 Claims, 5 Drawing Figures

FUEL PUMP COUNTER READOUT

DESCRIPTION

1. Technical Field

The present invention relates generally to mechanical fuel pump registers employed in fuel dispensing apparatus for registering the cost and volume amounts of fuel dispensed, for example as shown and described in U.S. Pat. No. 2,932,448 of H. N. Bliss, dated Apr. 12, 1960, and entitled "Resetting Mechanism for Counters", and relates more particularly to a new and improved counter readout for reading a rotary counter, notably a cost counter, of a fuel pump register.

Because of the increasing unit volume price of fuel and resulting increasing rate of rotation of the cost counter for any given volume rate of fuel delivered, the conventional ten-cent or a single-place right hand cost counter wheel is being replaced by a hundred-cent or two-place right hand wheel which is rotated one revolution for each one dollar or 100 cents of fuel delivered (and for that reason is sometimes referred to herein as a 100 value wheel).

The use of a 100 value right hand wheel has created a significant ambiguity problem in reading the cost counter during the transfer interval. That is because the usual "00", "05", "10", "15", "20", "25", "30", "35", "40" . . . two-place numeral indicia on a 100 value right hand wheel can produce a more ambiguous readout during the transfer interval than a prior conventional cost counter having separate tens and units cost counter wheels. As the right hand wheel rotates from "90" to "00" and the next higher order wheel is indexed one count, for example from "0" to "1" (e.g. as the cost counter rotates from $000.90 to $001.00) or both of the next two higher order wheels are indexed one count, for example from say "09" to "10" respectively (e.g. as the cost counter rotates from $009.90 to $010.00), the rotary cost counter could be misread as $001.95 rather than $000.95 or misread as $010.95 rather than $009.95 to cause a substantial (e.g. $1) cost readout error.

2. Background Art

Previous prior art proposals and modifications to the 100 value right hand wheel have been made to minimize to readout ambiguity problems without substantial success. The use of small, approximately half size readout indicia on the right hand wheel and the use of repeating small or approximately half size readout indicia on the second order wheel have been made with some success in reducing the ambiguity problem. However, small numerals being more difficult to read are undesirable.

Also, large substantially standard size ten-count readout numerals (i.e. "00"; "10"; "20" . . . "90" numerals) in conjunction with much smaller intermediate five-count readout numerals (i.e. "05"; "15"; "25" . . . "95" numerals) have been used on 100 value right hand wheels in connection with the conversion of the wheel from a single-place wheel to a two-place or 100 value wheel, without however resolving the readout ambiguity problem. With such 100 value wheel indicia, during a transfer, for example from 000.90 to 001.00, the 100 value wheel will display "95" when the next higher order wheel is half-way between 0 and 1. A misreading of 001.95 rather than the correct reading of 000.95 could easily result at that counter readout half-way through the transfer.

In accordance with the present invention a new and improved 100 value right hand wheel is provided for minimizing the transitional readout ambiguity problem. Pursuant to the present invention, the height of the readout numerals on the 100 value right hand wheel are approximately the same as the numeral height of the remaining conventional higher order counter wheels. Thus, the counter readability for example at ten feet or more from the fuel pump register is retained while minimizing the transfer readout ambiguity problem previously encountered.

It is another aim of the present invention to provide a new and improved 100 value right hand wheel which is readable to the nearest graduation provided (e.g. to the nearest 2 or 5 count). In accordance with the present invention the numeral indicia of the 100 value right hand wheel are provided only for the ten count increments (i.e. have only the numeral sequence "00"; "10"; "20"; "30" . . . "90") with each ten count increment being represented by a two-place numeral.

Other objects will be in part obvious and in part pointed out more in detail hereinafter.

A better understanding of the invention will be obtained from the following detailed description and the accompanying drawings of an illustrative application of the invention.

BEST MODE FOR CARRYING OUT THE INVENTION

Figure 1:
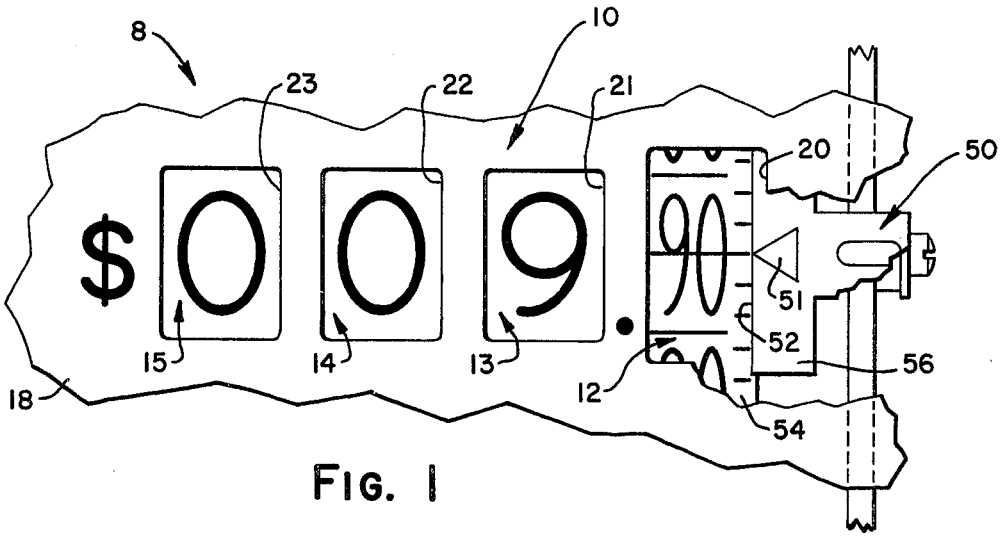
FIGS. 1–4 are front elevation views, partly broken away, of a fuel delivery pump register incorporating an embodiment of a cost counter readout of the present invention.

Referring now to the drawing in detail, wherein like numerals represent like parts throughout, there is shown a fuel pump register 8 having a rotary cost counter 10 incorporating an embodiment of the present invention. The rotary cost counter 10 has a horizontal axis in a conventional manner and may be identical to conventional rotary cost counters of the type employed in fuel dispensers and disclosed in the aforementioned U.S. Pat. No. 2,932,448 excepting for the specific details hereinafter described. The cost counter 10 comprises four coaxial counter wheels 12–15, of increasing order of significance from right to left. The four coaxial counter wheels have cylindrical outer indicia bearing rims of the same diameter and each of the wheel rims bears an annular arrangement of equiangularly spaced and axially extending readout numerals. In a conventional manner, the cost counter is driven for registering the cost amount of fuel delivered by associated fuel dispensing apparatus (not shown) in accordance with the volume amount of fuel delivered and the unit volume price established by a conventional mechanical price variator (not shown) employed in the cost counter drive train. The price variator may for example be an extended range variator capable of establishing a unit volume price up to $2.99 9/10 or more and for example be of the type disclosed in my U.S. Pat. No. 4,136,573, dated Jan. 30, 1979 and entitled "Extended Range Fuel Pump Computer Price Variator".

The disclosed four wheel cost counter 10 is capable of registering the cost amount of fuel to $999.98. The right hand, first or lowest order counter wheel 12 serves as a two-place wheel to provide both the units place (penny) and the tens place (ten cent) readings. The remaining higher order wheels serve as single place wheels in a conventional manner. Thus, the second or next higher order counter wheel 13 serves as a hundreds place (dollar) wheel and the third and fourth order counter wheels 14, 15 serve as ten dollar and hundred dollar wheels. All of the lower order counter wheels 12–14 are conventional single transfer wheels which rotate one revolution for each count transfer to the adjacent higher order wheel.

The two-place wheel 12 is marked with an annular arrangement of equiangularly spaced, relatively long ten-count and intermediate five-count increment graduations. The two-place wheel 12 is also shown marked with relatively short two-count increment graduations at the right hand edge of the wheel indicia rim. The relatively long 36° spaced ten-count increment graduations are identified with "00", "10", "20", "30", "40", "50", "60", "70", "80" and "90" respectively and the remaining intermediate five-count and two-count increment graduations are not specifically identified with numerals. The intermediate five-count increment graduations extend over one-half and approximately 85% the width of the wheel indicia rim from the left hand edge of the wheel rim to fall slightly short of the two-count graduations at the right hand edge of the wheel rim.

The ten-count increment graduations preferably extend substantially the full width of the wheel rim and are therefore longer than the intermediate five-count increment graduations. Also, all of the ten-count two-place numerals (i.e. "00"; "10" . . . "90") have the same axial width, are centered on the ten-count increment graduations (slightly to the left of center on the wheel rim) and are angularly elongated to have approximately the same height as the conventional numerals of the remaining higher order counter wheels 13–15. Specifically, the angular height of the numerals on the right hand wheel 12 and the remaining higher order wheels 13–15 is approximately 30°. Thus, the first order counter wheel 12 is readable from about the same distance as the remaining higher order wheels 13–15.

The ten-count increment graduations are clearly identified by the two-plate numerals since the numerals are centered on those graduations. Also, the intermediate five-count increment graduations are clearly identified by being both directly between and adjacent to the identifying numerals. Specifically, the centerline of the intermediate five-count increment graduations is only 3° from the adjacent numeral indicia.

In a generally conventional way the right hand or first order wheel 12 is connected to transfer a count to the second order wheel 13 at the end of each one revolution or one-hundred count of the two-plate wheel 12 and with the count transfer being effected as the two-place wheel 12 rotates through an angle of 36° from its "90" count position to its "00" count position. A count is similarly transferred from the second and third order wheels to the third and fourth order wheels respectively.

A register cover plate 18 is mounted in front of the counter wheels 12–15. The register cover plate 18 has four separate viewing windows 20–23 for the four cost counter wheels 12–15 respectively, for reading the front approximately 40° of each higher order wheel 13, 14 and 15 and for reading the front approximately 50° of the lowest order two-place wheel 12. The two-place wheel 12 has a somewhat larger viewing window than the remaining higher order counter wheels 13–15 to facilitate reading the counter as hereinafter explained.

A two-position readout pointer 50 is used for reading the counter. The readout pointer 50 shown is identical to that disclosed and described in my pending joint application Ser. No. 228,320, filed Jan. 26, 1981, now U.S. Pat. No. 4,347,435 entitled "Readout Mechanism For Fuel Pump Computer" and assigned to the same assignee as the present application, except that the pointer 50 is dimensioned to cover the larger viewing window 20. Briefly, the readout pointer 50 has an indicator 51 for reading the right hand counter wheel 12. In its 2¢ increment readout position shown in FIGS. 1–3, the pointer 50 is mounted so that its inner or left hand edge 52 is approximately aligned with the right hand edge of the lowest order wheel indicia rim 54 and therefore so that each relatively short two-count increment graduation as well as each relatively long ten-count and intermediate five-count increment graduation on the wheel rim 54 can be viewed for reading the two-place wheel 12 to the nearest two-count increment. In its second or alternative five-count increment readout position shown in FIG. 4, the pointer 50 is mounted so that a circumferentially extending mask 56 of the pointer 50 overlaps the right hand edge portion of the wheel indicia rim 54 to completely cover or mask the relatively short two-count increment graduations. Accordingly, with the pointer 50 in its five-count increment readout position shown in FIG. 4, the relatively long ten-count and intermediate five-count increment graduations are the only graduations visible for reading the wheel 12. Therefore, the wheel 12 is only readable to the nearest 5¢. In both axial positions of the pointer 50, the pointer 50 is angularly adjustable a few degrees so that it can be set exactly on the "00" graduation of the right hand wheel 12 with the cost counter wheels 12–15 in their zero positions to which they are reset between fuel deliveries.

The identifying numerals and ten-count and intermediate five-count increment graduations on the right hand counter wheel 12 are provided so that the cost counter readout is unlikely to be improperly read or interpreted during the 36° transfer interval as the count is transferred from the right hand two-place wheel 12 to the next higher order wheel 13. In that regard, FIGS. 1–3 show the cost counter readout as the counter is indexed from a "$009.90" readout position (FIG. 1) to a "$009.98" readout position (FIG. 3)—i.e. to a position just before reaching its "$010.00" readout position at the completion of the count transfer interval.

Figure 2:
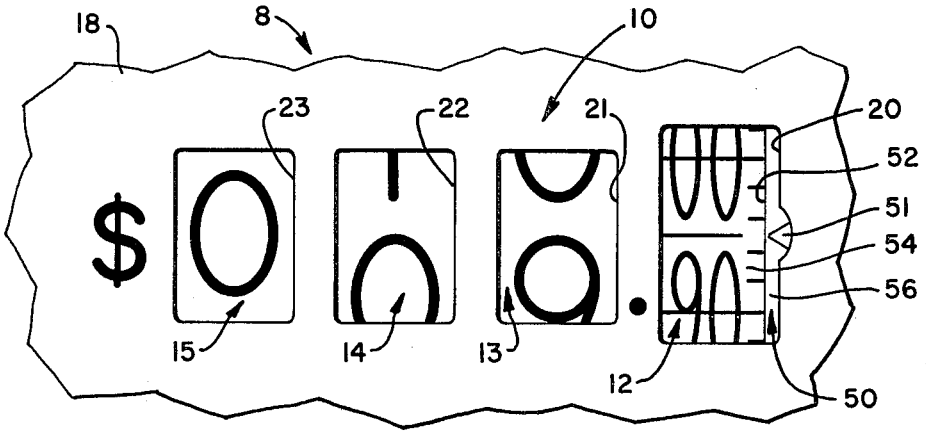

In FIG. 1, the $009.90 reading of the cost counter just prior to the commencement of a count transfer is clear. In FIG. 2, the cost counter is shown half-way through the transfer interval. In that position, the right hand wheel reading of "95" is clear because the "90" and "00" readings are sufficiently visible to be readable. Also, the intermediate five-count increment graduation aligned with the pointer 50 obviously represents "95" because it is clearly half-way between the "90" and "00" graduations. Further, since the direction of rotation of the right hand two-place wheel 12 is obvious in view of the readability of the "90" and "00" identifying numerals, it should be clear (even without conscious thought) that the dollar wheels are also rotating from "09" to "10". Therefore, the correct "$009.95" cost reading is essentially automatically made without confusion or need for conscious reasoning. Also, if one consciously attempts to analyze the cost counter reading, only the correct "$009.95" reading would be made. Thus the readout is not ambiguous as in the prior art 100 value wheels employing both ten-count and intermediate five-count readout numerals.

Figure 3:
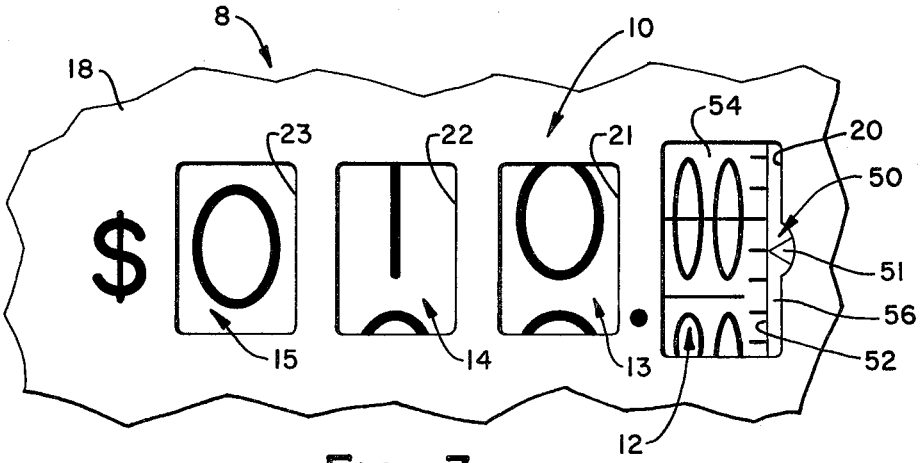
Figure 4:
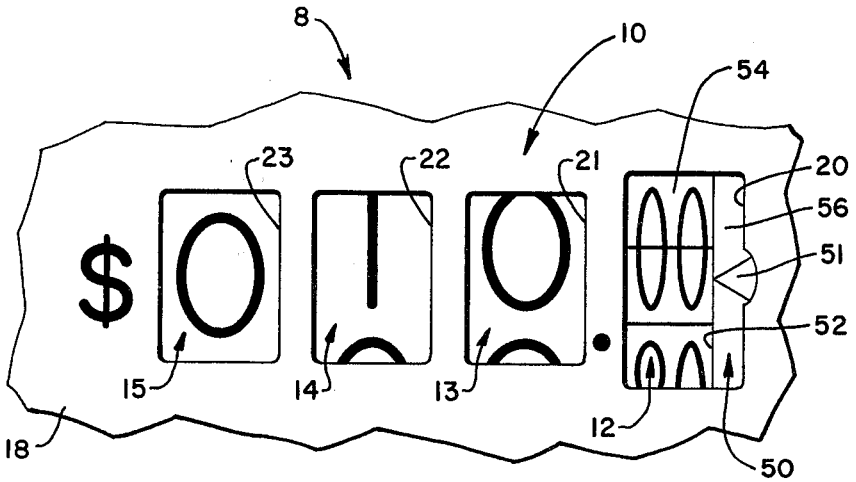
Figure 5:
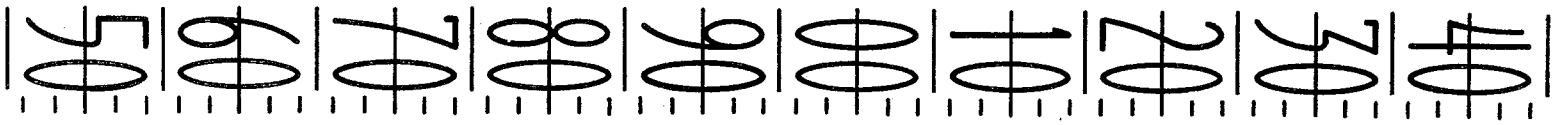
FIG. 5 is a layout of the outer indicia of the right hand two-place wheel of the cost counter.

In FIG. 3, the cost counter is shown just prior to the completion of the count transfer interval. In that readout position of the counter, it is obvious that the cost counter reading is approaching but is less than "$010.00" since all of transitioning counter wheels are simultaneously approaching that reading. Also, upon analysis, because the long intermediate five-count increment graduation is clearly half-way between the "90" and "00" numeral indicia, it clearly represents "95". Accordingly, the right hand counter wheel 12 can be accurately read between its "95" and "00" readout positions. As shown in FIG. 3, the counter wheel readout of "$009.98" can be determined without confusion.

Thus, the long ten-count increment graduations, the large generally standard height numerals centered thereon and the long intermediate five-count increment graduations between the identifying numerals provide for clearly establishing the reading of the right hand counter wheel as the cost counter approaches a full dollar reading (i.e. as the right hand two-place cost counter wheel 12 approaches a "00" reading). Accordingly, upon analysis, as the cost counter approaches a full dollar reading, the cost counter would be accurately interpreted (e.g. as having a readout of "$009.98" instead of "$010.02" in FIG. 3 and a readout of "$009.95" instead of "$010.05" or "$010.95" in FIG. 2) to avoid cost counter ambiguity and customer confusion.

As will be apparent to persons skilled in the art, various modifications, adaptations and variatons of the foregoing specific disclosure can be made without departing from the teachings of the present invention.

I claim:

1. In a fuel dispenser counter for registering the accumulated count of fuel delivered and having a plurality of counter wheels coaxially mounted in ascending order of significance from right to left as the counter is read from the front thereof, the plurality of counter wheels having respective generally cylindrical indicia rims of generally the same diameter; the first order counter wheel being a two-place counter wheel with a one-part indicia rim and an annular arrangement of readout indicia thereon comprising a plurality of angularly spaced and axially extending count increment graduations including equiangularly spaced ten-count increment graduations and intermediate five-count increment graduations therebetween and a sequence of two-place axially readable identifying numerals of substantially constant axial width consisting solely of the numerals 00, 10, 20, 30, 40, 50, 60, 70, 80, and 90 for the ten-count increment graduations respectively; the remaining higher order counter wheels being one-place counter wheels, each with an annular arrangement of a sequence of one-place axially readable identifying numerals on its indicia rim of 0, 1, 2, 3, 4, 5, 6, 7, 8, 9; and a graduation indicator adjacent said first order counter wheel indicia rim for reading the accumulated count of the counter from the said front thereof including the accumulated count of the first order counter wheel with its identifying numerals and axially extending graduations; the improvement wherein the said ten-count and intermediate five-count graduations extend at least substantially the entire axial width of the two-place identifying numerals, wherein the said two-place identifying numerals are substantially angularly centered on the respective ten-count graduations and extend in both angular directions therefrom to adjacent the next said intermediate five-count graduations, and wherein said intermediate five-count graduations are directly between the two-place identifying numerals.

2. A fuel dispenser counter according to claim 1 wherein the said ten-count graduations have an angular spacing of substantially 36°.

3. A fuel dispenser counter according to claim 1 wherein the said ten-count graduations extend axially to the right further than the said intermediate five-count graduations.

4. A fuel dispenser counter according to claim 1 wherein the said ten-count graduations extend to substantially the right hand edge of the first order counter wheel indicia rim as the counter is read from the front thereof and wherein the count increment graduations include relatively short intermediate two-count graduations, between the said ten-count graduations, along the said right hand edge of the first order counter wheel indicia rim.

5. A fuel dispenser counter according to any one of claims 1 through 4, wherein the counter has a front cover plate with a separate viewing window for each of the plurality of counter wheels for reading the count thereof from the said front of the counter and wherein the viewing window for the first order counter wheel has a height for viewing an angular part of its indicia rim substantially more than the angle between the ten-count graduations.

6. A fuel dispenser counter according to claim 5 wherein the height of the viewing windows provides for viewing approximately 50° of the first order counter wheel and approximately 40° of the remaining higher order counter wheels.

7. A fuel dispenser counter according to any one of claims 1 through 3 wherein the count increment graduations include relatively short intermediate two-count graduations, between the said ten-count graduations, along the said right hand edge of the first order counter wheel indicia rim.

8. A fuel dispenser counter according to claim 7 wherein the graduation indicator is selectively mountable to selectively mask the two-count increment graduations along the right hand edge of the first order counter wheel rim for selectively providing a first order wheel readout to the nearest two-count or nearest five-count increment.

* * * * *